US007836683B2

(12) United States Patent
Hoshi

(10) Patent No.: US 7,836,683 B2
(45) Date of Patent: Nov. 23, 2010

(54) CONTROL APPARATUS AND METHOD FOR INTERNAL COMBUSTION ENGINE

(75) Inventor: Koichi Hoshi, Susono (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 944 days.

(21) Appl. No.: 11/709,769

(22) Filed: Feb. 23, 2007

(65) Prior Publication Data

US 2007/0199305 A1 Aug. 30, 2007

(30) Foreign Application Priority Data

Feb. 24, 2006 (JP) ..... 2006-048429

(51) Int. Cl.
*F01N 3/00* (2006.01)

(52) U.S. Cl. ..... 60/285; 60/277; 60/276

(58) Field of Classification Search ..... 60/285, 60/277, 276

See application file for complete search history.

(56) References Cited

U.S. PATENT DOCUMENTS

2005/0193721 A1* 9/2005 Surnilla et al. ..... 60/285
2005/0193722 A1* 9/2005 Fujiwara et al. ..... 60/285

FOREIGN PATENT DOCUMENTS

JP 5-195852 8/1993
JP 6-017676 1/1994
JP 6-058193 3/1994
JP 6-147081 5/1994
JP 6-221202 8/1994
JP 8-144814 6/1996
JP 8-144816 6/1996
JP 8-189387 7/1996
JP 10-103124 4/1998
JP 2001-329872 11/2001
JP 2004-068690 3/2004
JP 2005-351126 12/2005

OTHER PUBLICATIONS

Japanese Office Action issued Apr. 7, 2009.

* cited by examiner

*Primary Examiner*—Thomas E Denion
*Assistant Examiner*—Michael Carton
(74) *Attorney, Agent, or Firm*—Finnegan, Henderson, Farabow, Garrett & Dunner, LLP

(57) ABSTRACT

A control apparatus for an internal combustion engine that includes right and left banks, first and second catalysts provided in the right and left exhaust pipes, respectively, and a downstream catalyst provided in a common exhaust pipe downstream of the upstream catalysts is adapted to alternately switch execution of catalyst degradation minimization and execution of fuel cut between the two banks if at least one of the temperature of the first catalyst and temperature of the second catalyst is higher than a predetermined value during deceleration of the internal combustion engine.

12 Claims, 10 Drawing Sheets

CONTROL APPARATUS AND METHOD FOR INTERNAL COMBUSTION ENGINE

INCORPORATION BY REFERENCE

The disclosure of Japanese Patent Application No. 2006-048429 filed on Feb. 24, 2006 including the specification, drawings and abstract is incorporated herein by reference in its entirety.

BACKGROUND OF THE INVENTION

1. Field of the Invention

The invention relates to a control apparatus and method for an internal combustion engine, and particularly to a control apparatus and method for an internal combustion engine that includes upstream catalysts provided for multiple cylinder groups, respectively, and a downstream catalyst that is provided in an exhaust passage downstream of the confluence of exhaust passages provided downstream of the upstream catalysts, respectively.

2. Description of the Related Art

For example, Japanese patent application publication No. JP-A-08-144814 describes a control apparatus that performs fuel cut when the internal combustion engine is decelerating. According to this control apparatus, execution of the fuel cut is prohibited when the temperature of the catalyst provided in the exhaust passage is high. During fuel cut, a lean gas is supplied to the catalyst, and degradation of the catalyst is promoted when the catalyst is heated to a high temperature under a lean atmosphere. Accordingly, the control apparatus in this publication can minimize such degradation of the catalyst by prohibiting fuel cut as described above.

For example, an internal combustion engine, typically a V-type engine, employs an arrangement of exhaust components in which upstream catalysts are separately provided for two cylinder groups and a downstream catalyst is provided in an exhaust passage downstream of the confluence of the exhaust passages extending downstream of the respective upstream catalysts. Also in an internal combustion engine having this arrangement, the control method described in the above-mentioned publication may be implemented in order to minimize degradation of the catalysts.

In the this case, however, if control is performed so as to avoid the upstream catalysts being heated to a high temperature under a lean atmosphere as described above, the downstream catalyst is exposed to a rich atmosphere. That is, catalysts absorb sulfur oxides under a lean atmosphere and release the absorbed sulfur oxides under a rich atmosphere, and therefore avoiding the upstream catalysts being heated under a lean atmosphere in the above-described manner may promote production of catalyst exhaust odor.

On the other hand, if control is performed so as to avoid the downstream catalyst being exposed to a rich atmosphere in order to minimize catalyst exhaust odor, it in turn promotes degradation of the upstream catalysts, and eventually degradation of the downstream catalyst as well. That is, in an internal combustion engine having the above-described arrangement of exhaust components, it has been difficult to perform control for minimizing overall catalyst degradation and control for minimizing catalyst exhaust odor in a compatible manner.

SUMMARY OF THE INVENTION

The invention provides a control apparatus and method for an internal combustion engine including two cylinder groups, upstream catalysts provided for the respective cylinder groups, a downstream catalyst provided in an exhaust passage downstream of the confluence of exhaust passages provided downstream of the respective upstream catalysts, and the control apparatus and method of the invention enable to perform minimization of overall catalyst degradation and minimization of exhaust odor in a compatible manner.

A first aspect of the invention relates to a control apparatus for an internal combustion engine including: a first cylinder group; a second cylinder group; a first exhaust passage provided for the first cylinder group; a second exhaust passage provided for the second cylinder group; a first upstream catalyst provided in the first exhaust passage; a second upstream catalyst provided in the second exhaust passage; and a downstream catalyst provided in a third exhaust passage provided downstream of a confluence of the first exhaust passage and the second exhaust passage, the confluence being located downstream of the first upstream catalyst and the second upstream catalyst. The control apparatus includes a fuel supply suspending portion that suspends supply of fuel to at least one of the first cylinder group and the second cylinder group under a predetermined state of the internal combustion engine. The control apparatus further includes a fuel supply suspension prohibiting portion that prohibits execution of the fuel supply suspension control by the fuel supply suspending portion when at least one of a temperature of the first upstream catalyst and a temperature of the second upstream catalyst is higher than a predetermined value and a fuel supply suspension prohibition switching portion that alternately switches the cylinder group in which the fuel supply suspension prohibiting control is executed by the fuel supply suspension prohibiting portion between the first cylinder group and the second cylinder group.

According to this structure, since the fuel supply suspension prohibiting control is alternately performed between the cylinder groups, minimization of catalyst degradation and minimization of exhaust odor can be performed in a compatible manner.

A second aspect of the invention relates to a control method for an internal combustion engine including: a first cylinder group; a second cylinder group; a first exhaust passage provided for the first cylinder group; a second exhaust passage provided for the second cylinder group; a first upstream catalyst provided in the first exhaust passage; a second upstream catalyst provided in the second exhaust passage; and a downstream catalyst provided in a third exhaust passage provided downstream of a confluence of the first exhaust passage and the second exhaust passage, the confluence being located downstream of the first upstream catalyst and the second upstream catalyst. In this control method, supply of fuel to at least one of the first cylinder group and the second cylinder group is suspended under a predetermined state of the internal combustion engine. Further, in this control method, execution of the fuel supply suspension control is prohibited when at least one of a temperature of the first upstream catalyst and a temperature of the second upstream catalyst is higher than a predetermined value, and the cylinder group in which the fuel supply suspension prohibiting control is executed is alternatively switched between the first cylinder group and the second cylinder group.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF THE PREFERRED EMBODIMENTS

Figure 1:
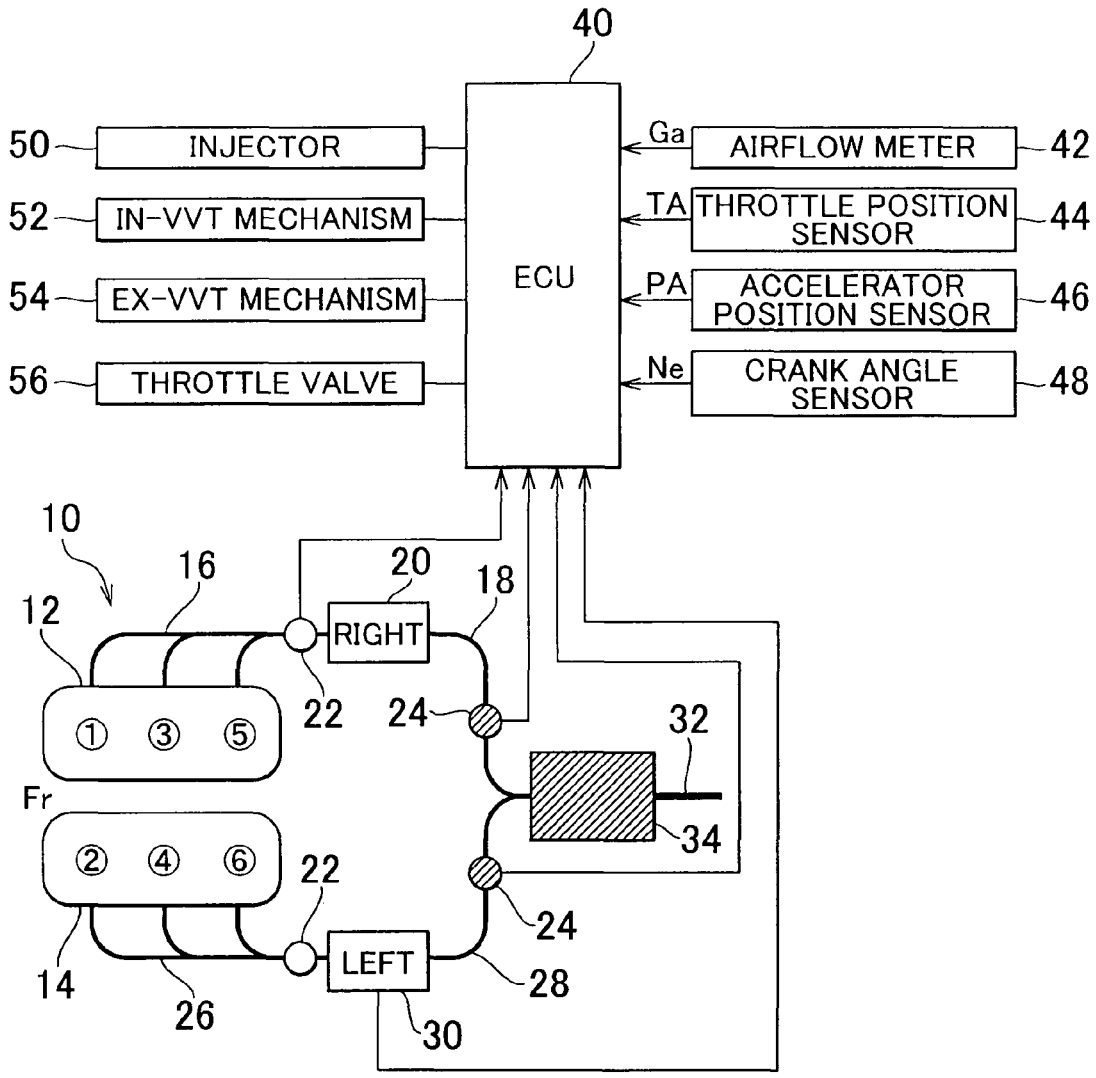
FIG. 1 is a view showing the configuration of a system according to the first exemplary embodiment of the invention.

FIG. 1 illustrates the configuration of the system according to a first exemplary embodiment of the invention, which mainly shows the exhaust system of an internal combustion engine 10. Referring to FIG. 1, the system of the first exemplary embodiment includes the internal combustion engine 10 that is a V6 engine having a right bank 12 consisting of cylinders #1, #3, and #5 and a left bank 14 consisting of cylinders #2, #4, and #6.

The exhaust system of the internal combustion engine 10 includes a right exhaust manifold 16 connected to the right bank 12 and a right exhaust pipe 18 connected to the right exhaust manifold 16. The exhaust gases discharged from the three cylinders in the right bank 12 converge at the right exhaust manifold 16 and then flow therefrom to the right exhaust pipe 18. A right upstream catalyst 20 that purifies exhaust gas is provided midway in the right exhaust pipe 18, and an air-fuel ratio sensor 22 is provided upstream of the right upstream catalyst 20. The air-fuel ratio sensor 22 detects the air-fuel ratio of exhaust gas at this position. Further, a sub-$O_2$ sensor 24 that outputs a signal indicating whether the air-fuel ratio, which has been detected at the position of the sub-$O_2$ sensor 24, is rich or lean is provided downstream of the right upstream catalyst 20.

As in the right bank, the exhaust system of the internal combustion engine 10 also includes a left exhaust manifold 26, a left exhaust pipe 28, and a left upstream catalyst 30, and an air fuel ratio sensor 22 and a sub-$O_2$ sensor 24 are provided upstream and downstream of the left upstream catalyst 30, respectively.

Further, the exhaust system of the internal combustion engine 10 includes a common exhaust pipe 32 connected to the right exhaust pipe 18 and the left exhaust pipe 28. The exhaust gases discharged from the right bank 12 and the left bank 14 flow through the right exhaust pipe 18 and the left exhaust pipe 28, respectively, and converge at the common exhaust pipe 32. A downstream catalyst 34 that purifies exhaust gas is provided midway in the common exhaust pipe 32.

The system shown in FIG. 1 includes an ECU (Electronic Control Unit) 40. As well as the sensors described above, various other sensors are connected to the ECU 40, such as an air-flow meter 42 that detects intake air amount Ga, a throttle position sensor 44 that detects a throttle angle TA, an accelerator position sensor 46 that detects an accelerator operation amount PA, and a crank angle sensor 48 that detects an engine speed Ne.

Also connected to the ECU 40 are various actuators, such as fuel injection valves 50 that inject fuel into the respective cylinders, an intake VVT (Variable Valve Timing) mechanism 52 that variably controls the operation timing of the intake valves, an exhaust VVT mechanism 54 that variably controls the operation timing of the exhaust valves, and an electronically-controlled throttle valve 56. The ECU 40 drives these actuators according to corresponding control programs using the outputs from various sensors.

The ECU 40 sets an idling ON flag to ON in response to the throttle angle TA being changed to an idling angle (a fully closed angle). In the system of this exemplary embodiment, suspension of fuel injection, that is, fuel cut (F/C) is performed when the idling ON flag is ON and predetermined conditions are not in effect. Because fuel injection is not performed during fuel cut, the air-fuel ratios of the exhaust gases flowing into the upstream catalysts 20, 30 are lean.

When a lean exhaust gas enters a high temperature catalyst, the catalyst progressively degrades due to sintering (grain growth) of the precious metal in the catalyst. To counter this, the system of this exemplary embodiment prohibits execution of fuel cut when the temperature of the catalyst is higher than a threshold even if the idling ON flag is ON. At this time, more specifically, the system continues engine combustion at a stoichiometric air-fuel ratio (will be simply referred to as "stoichiometric combustion"). The control that prohibits execution of fuel cut during deceleration if the temperature of each upstream catalyst 20, 30 is high as described above will hereinafter be referred to as "catalyst degradation minimization control". According to this catalyst degradation minimization control, it is possible to avoid a high temperature catalyst being exposed to an oxidizing atmosphere, and therefore degradation of the catalyst can be minimized.

When the air-fuel ratio of the exhaust gas flowing through the catalyst is lean, each of the catalysts provided in the exhaust passages of the internal combustion engine 10 absorbs sulfur oxides ($SO_X$) produced by combustion of sulfur components contained in fuel. Moreover, even when the air-fuel ratio of the exhaust gas flowing through the catalyst is the stoichiometric air-fuel ratio, the catalyst absorbs sulfur oxides in exhaust gas if the catalyst has a sufficient amount of oxygen (if the catalyst is in a lean atmosphere (an oxidizing atmosphere)). Owing to such an effect, each catalyst absorbs sulfur oxides in exhaust gas during the normal operation of the internal combustion engine 10 in which the internal combustion engine 10 is controlled such that the air-fuel ratio of exhaust gas equals the stoichiometric air-fuel ratio.

On the other hand, in the case that the air-fuel ratio of exhaust gas flowing through the catalyst is rich or is equal to the stoichiometric air-fuel ratio while the catalyst does not have a sufficient amount of oxygen (i.e., while the catalyst is in a rich atmosphere (a reducing atmosphere)), the catalyst releases the absorbed sulfur oxidizes. The sulfur oxides thus released into exhaust gas react with hydrogen to form hydrogen sulfides ($H_2S$), and when released to the outside, the hydrogen sulfides cause exhaust odor (odor of hydrogen sulfides).

Thus, the system of the first exemplary embodiment allows execution of fuel cut under a predetermined condition even when the temperature of each upstream catalyst 20, 30 is high during deceleration of the internal combustion engine 10, in order to prevent the downstream catalyst 34 from being exposed to a rich atmosphere. This control will hereinafter be referred to as "catalyst exhaust odor minimization control" where appropriate. According to this catalyst exhaust odor minimization control, execution of fuel cut is allowed so that a sufficient amount of oxygen is supplied to the downstream catalyst 34 and thus the downstream catalyst 34 is exposed to a lean atmosphere. In this way, it is possible to prevent a situation that induces the sulfur oxides in the downstream catalyst 34 to be released to the outside in the form of hydrogen sulfides. Accordingly, exhaust odor can be minimized.

Being close to the combustion chambers, the temperatures of the upstream catalysts 20, 30 tend to be higher than the downstream catalyst 34. In view of minimizing degradation of the upstream catalysts 20, 30, it is desirable that, when the condition for executing the fuel cut during engine deceleration is in effect, the above-described catalyst degradation minimization control be performed for all the cylinders, that is, stoichiometric combustion be continued even when the internal combustion engine 10 is decelerating, so as to prevent the upstream catalysts 20, 30 from being exposed to a high temperature lean atmosphere. However, in the case of the internal combustion engine 10 having the exhaust system that includes the upstream catalysts 20, 30 separately provided for the right bank 12 and the left bank 14 and the downstream catalyst 34 provided in the common exhaust pipe 32 downstream of the upstream catalysts 20, 30, performing the above-mentioned control may cause the following problems.

That is, fuel cut is executed in response to the fuel-cut execution condition being satisfied during deceleration of the internal combustion engine 10 in the state where the temperatures of the upstream catalysts 20, 30 are considered not to be high, and it causes the downstream catalyst 34 to be exposed to a lean atmosphere. When the downstream catalyst 34 is exposed to a lean atmosphere, the sulfur oxides ($SO_X$) produced by subsequent engine combustions are absorbed by the downstream catalyst 34. In this case, if the temperatures of the upstream catalysts 20, 30 become high later and the catalyst degradation minimization control is then performed for all the cylinders, the downstream catalyst 34 is exposed to a rich atmosphere, allowing the sulfur oxides in the downstream catalyst 34 to be released to the outside in the form of hydrogen sulfides and thus causing exhaust odor.

In the above state, if the control is performed so as to avoid the downstream catalyst being exposed to a rich atmosphere in order to prevent the aforementioned problem, it in turn promotes degradation of the upstream catalysts 20, 30, and eventually degradation of the downstream catalyst 34 as well. As such, in the case of the internal combustion engine 10 having the exhaust system configured according to the first exemplary embodiment, it is difficult to achieve minimization of the overall degradation of the catalysts 20, 30, 34, and minimization of exhaust odor in a compatible manner.

Thus, in order to achieve both minimization of overall catalyst degradation and minimization of exhaust odor, the system of the first exemplary embodiment alternately switches execution of the catalyst degradation minimization control (fuel-cut prohibition, that is, stoichiometric combustion) and execution of the catalyst exhaust odor minimization control (fuel cut) between the right bank 12 and the left bank 14 of the internal combustion engine 10, when the temperature of each upstream catalyst 20, 30 is determined to be high during deceleration of the internal combustion engine 10.

Figure 2:
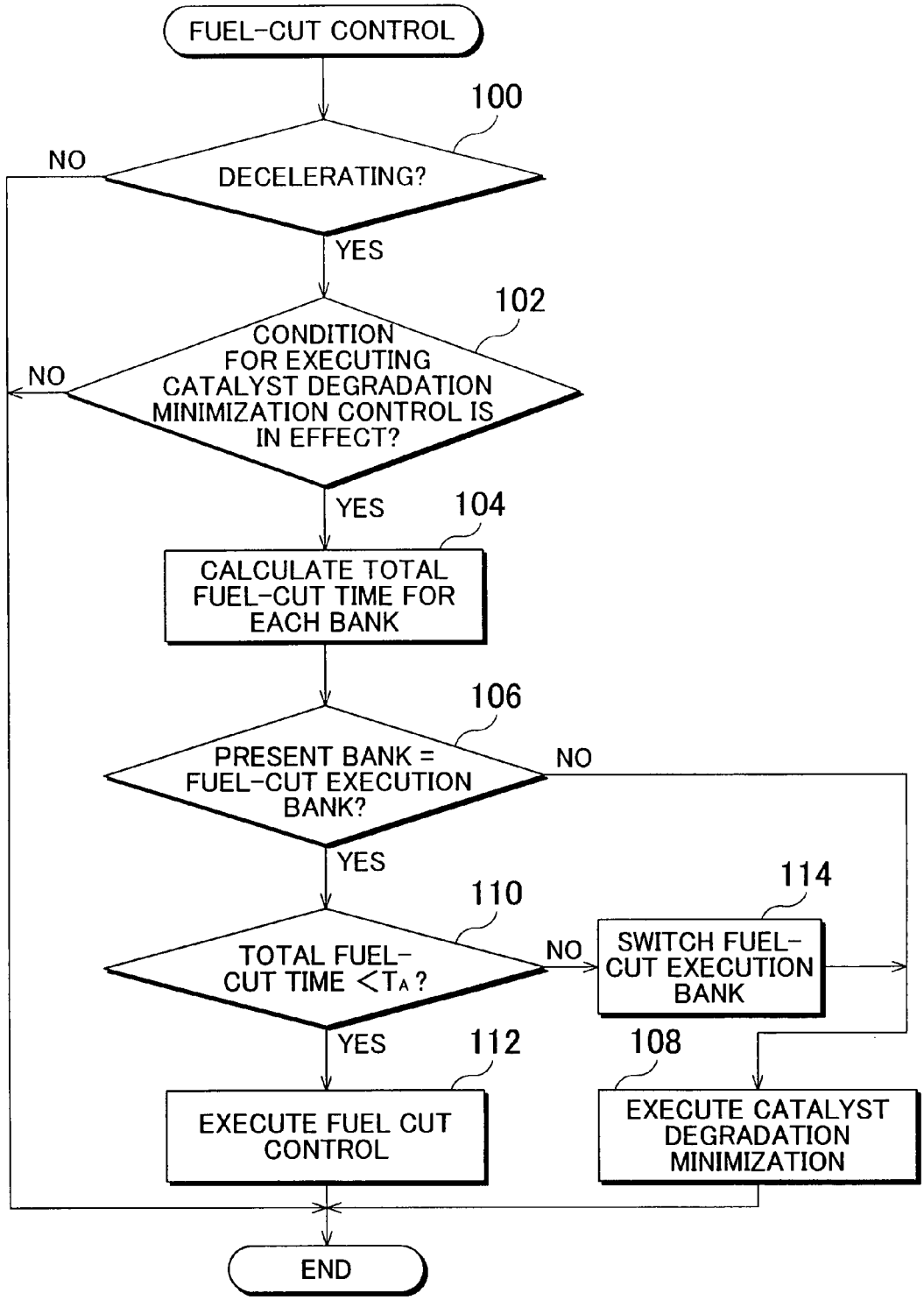
FIG. 2 is a flowchart showing a control routine executed in the first exemplary embodiment of the invention.

FIG. 2 is a flowchart showing a control routine executed by the ECU 40 to realize the above control in the first exemplary embodiment. This control routine is executed at a predetermined timing at which whether to perform fuel injection is determined for each cylinder in each cycle.

According the control routine shown in FIG. 2, whether the internal combustion engine 10 is decelerating is first determined based on, for example, the state of the idling-ON flag (step 100). If it is determined that the internal combustion engine 10 is decelerating, it is then determined whether the condition for executing the catalyst degradation minimization control is in effect (step 102). Specifically, this condition is determined to be in effect when the present temperature of each upstream catalyst 20, 30 is higher than a threshold. Note that the temperatures of the upstream catalysts 20, 30 can be estimated using, for example, a map defined based on the relations with the intake air amount Ga and the engine speed Ne.

If it is determined in step 102 that the condition for executing the catalyst degradation minimization control is not in effect, the present cycle of the control routine ends at once. In this case, fuel cut is performed for all the cylinders if any other condition for prohibiting execution of fuel cut is not in effect.

On the other hand, if it is determined in step 102 that the condition for executing the catalyst degradation minimization control is in effect, the total fuel-cut time of each of the right and left banks 12, 14 of the internal combustion engine 10 is calculated (step 104). In this way, in this control routine, when execution of the catalyst degradation minimization control is required, the bank in which fuel cut is prohibited is switched between the right bank 12 and left bank 14 based on the total fuel-cut time of each bank 12, 14.

Figures 3A, 3B, 3C, 3D, 3E:
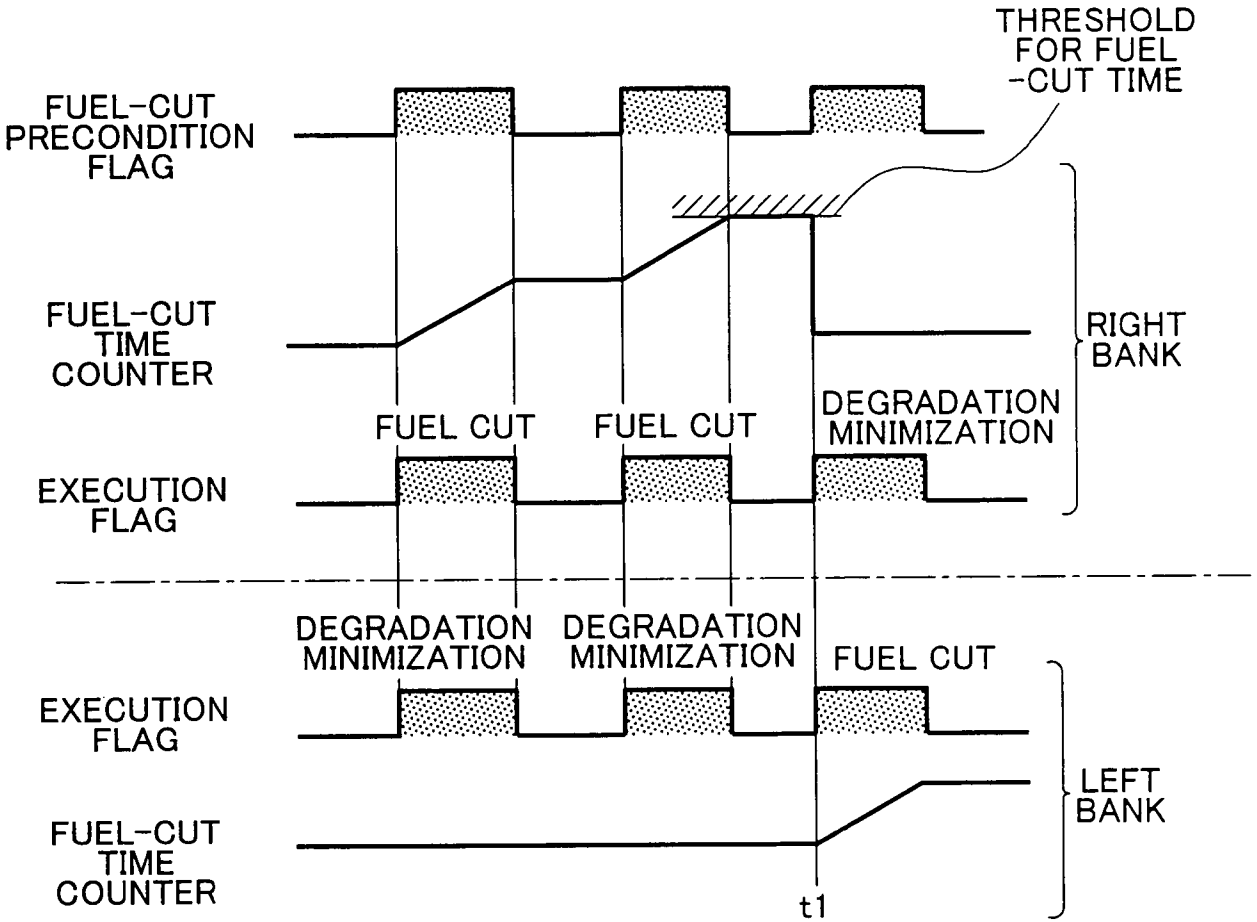
FIG. 3A to FIG. 3E are time charts illustrating the method for counting the total fuel-cut time and the timing for switching the bank in which execution of fuel-cut is prohibited.

FIG. 3 is a time chart illustrating the method of counting the aforementioned total fuel-cut time and the timing for switching the bank in which execution of fuel cut is prohibited. Specifically, FIG. 3A represents waveforms indicating the ON/OFF states of a fuel-cut execution precondition flag, FIG. 3B represents waveforms indicating changes in the value of a total fuel-cut time counter for the right bank 12, FIG. 3C represents waveforms indicating the ON/OFF states of a fuel-cut execution flag for the right bank 12, FIG. 3D represents waveforms indicating the ON/OFF states of a fuel-cut execution flag for the left bank 14, and FIG. 3E represents waveforms indicating changes in the value of a total fuel-cut time counter for the left bank 14.

Referring to FIG. 3, when the fuel-cut execution precondition (catalyst degradation minimization execution condition) flag is ON, the ECU 40 executes fuel cut for the cylinders in one of the right and left banks 12, 14 that is presently defined as the fuel-cut execution bank as shown in FIGS. 3C and 3D, respectively, and during this, the total fuel-cut time counter counts the total fuel-cut time as shown in FIG. 3B and FIG. 3E, respectively. Note that the example illustrated in FIG. 3 is an example in which the right bank 12 is defined as the fuel-cut execution bank. In this case, fuel cut is executed in the right bank 12 (FIG. 3C) and the catalyst degradation minimization control (stoichiometric combustion) is performed in the left bank 14 (FIG. 3E).

When the total fuel-cut time of the right bank 12 reaches a predetermined threshold at time t1 as shown in FIG. 3B, the total fuel-cut time of the right bank 12 is reset to zero and the fuel-cut execution bank is switched from the right bank 12 to the left bank 14. Then, when the fuel-cut execution precondition comes into effect next time, fuel cut is executed in the left bank 14 (FIG. 3D), and the total fuel-cut time of the left bank 14 is counted (FIG. 3E). At this time, the catalyst degradation minimization control is performed in the right bank 12 (FIG. 3C). When the total fuel-cut time of the left bank 14 reaches the threshold, the fuel-cut execution bank is then switched back to the right bank 12.

Next, detailed description will be made of the control processes executed by the ECU 40 in the control routine in FIG. 2. In the control routine in FIG. 2, after the total fuel-cut time of the right bank 12 or the left bank 14 has been calculated in step 104, it is then determined whether the cylinder corresponding to the present cycle of the control routine belongs to the fuel-cut execution bank (step 106). Note that whether an initial fuel-cut execution bank is the right bank 12 or the left bank 14 is defined in the initial setting of the ECU 40.

If it is determined in step 106 that the cylinder corresponding to the present cycle of the control routine does not belong to the fuel-cut execution bank, the catalyst degradation minimization control is performed in this cylinder, in other words, execution of fuel cut is prohibited and stoichiometric combustion is performed in the cylinder (step 108).

On the other hand, if it is determined in step 106 that the cylinder corresponding to the present cycle of the control routine belongs to the fuel-cut execution bank, it is then determined whether the total fuel-cut time of the present fuel-cut execution bank is less than the threshold $T_A$ (step 110).

If it is determined in step 110 that the total fuel-cut time has not yet reached the threshold $T_A$, fuel cut control (catalyst exhaust odor minimization control) is performed in this cylinder in order to avoid the downstream catalyst 34 being exposed to a rich atmosphere (step 112).

On the other hand, if it is determined in step 110 that the total fuel-cut time has reached the threshold $T_A$, the fuel-cut execution bank is switched to other bank (step 114), and the catalyst degradation minimization control is performed in the cylinder corresponding to the present cycle of the control routine (step 108).

Figures 4A, 4B, 4C, 4D, 4E, 4F:
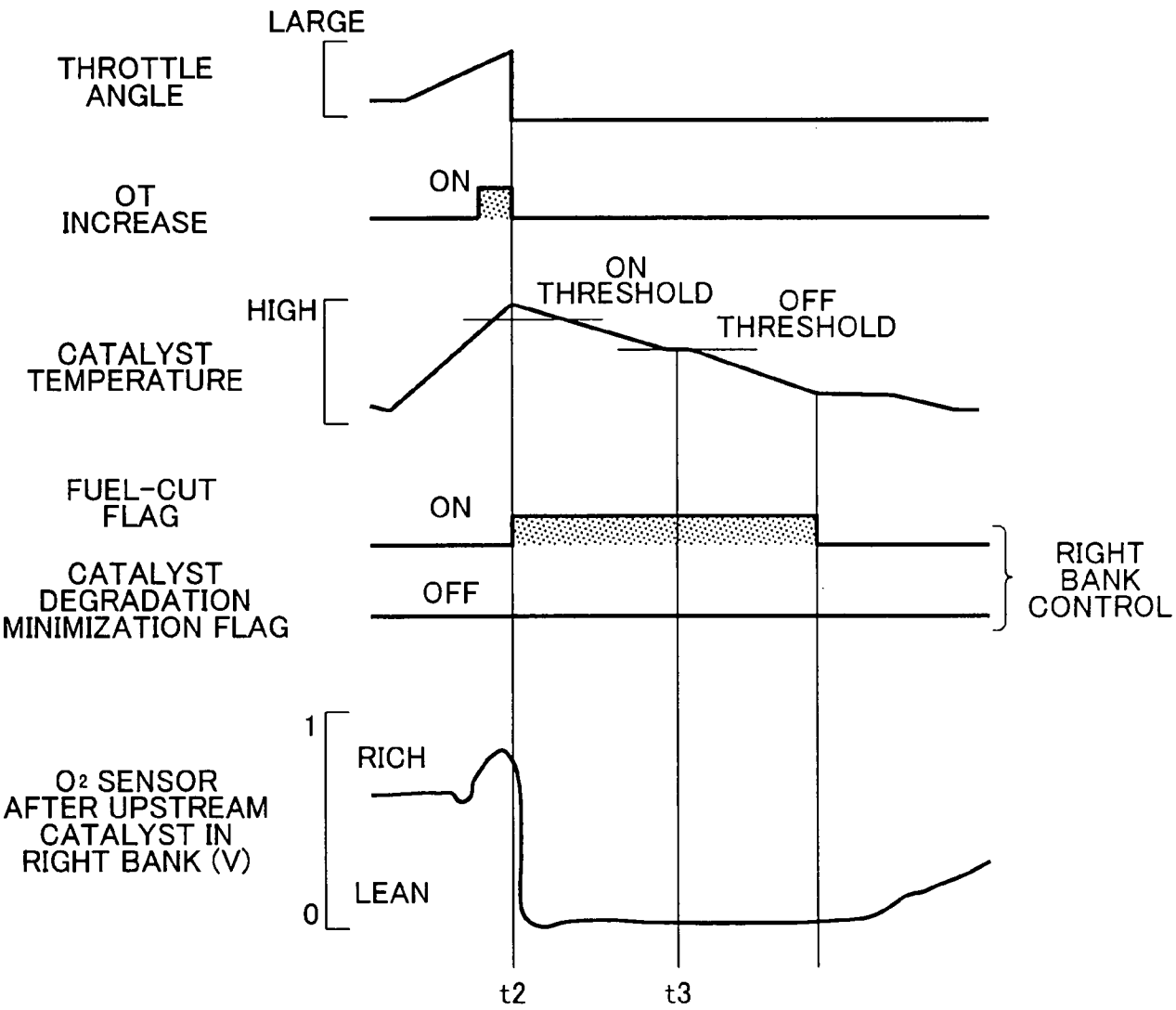
FIG. 4A to FIG. 4J are charts illustrating the states of the upstream and downstream catalysts when fuel-cut is being executed in the right bank and the catalyst degradation minimization control is being executed in the left bank while the condition for executing fuel cut is in effect.

FIG. 4 is a chart illustrating the states of the upstream catalysts 20, 30, the downstream catalyst 34, when fuel cut is being executed in the right bank 12 and the catalyst degradation minimization control is being performed in the left bank 14 while the condition for executing the catalyst degradation minimization control is in effect. As in the example shown in FIG. 4, there is a case that the throttle angle shapely increases in response to the accelerator being operated (FIG. 4A) and the amount of OT is increased (fuel injection amount is increased) in order to suppress an increase in the temperature of the components of the exhaust system (FIG. 4B).

Figures 4G, 4H, 4I, 4J:
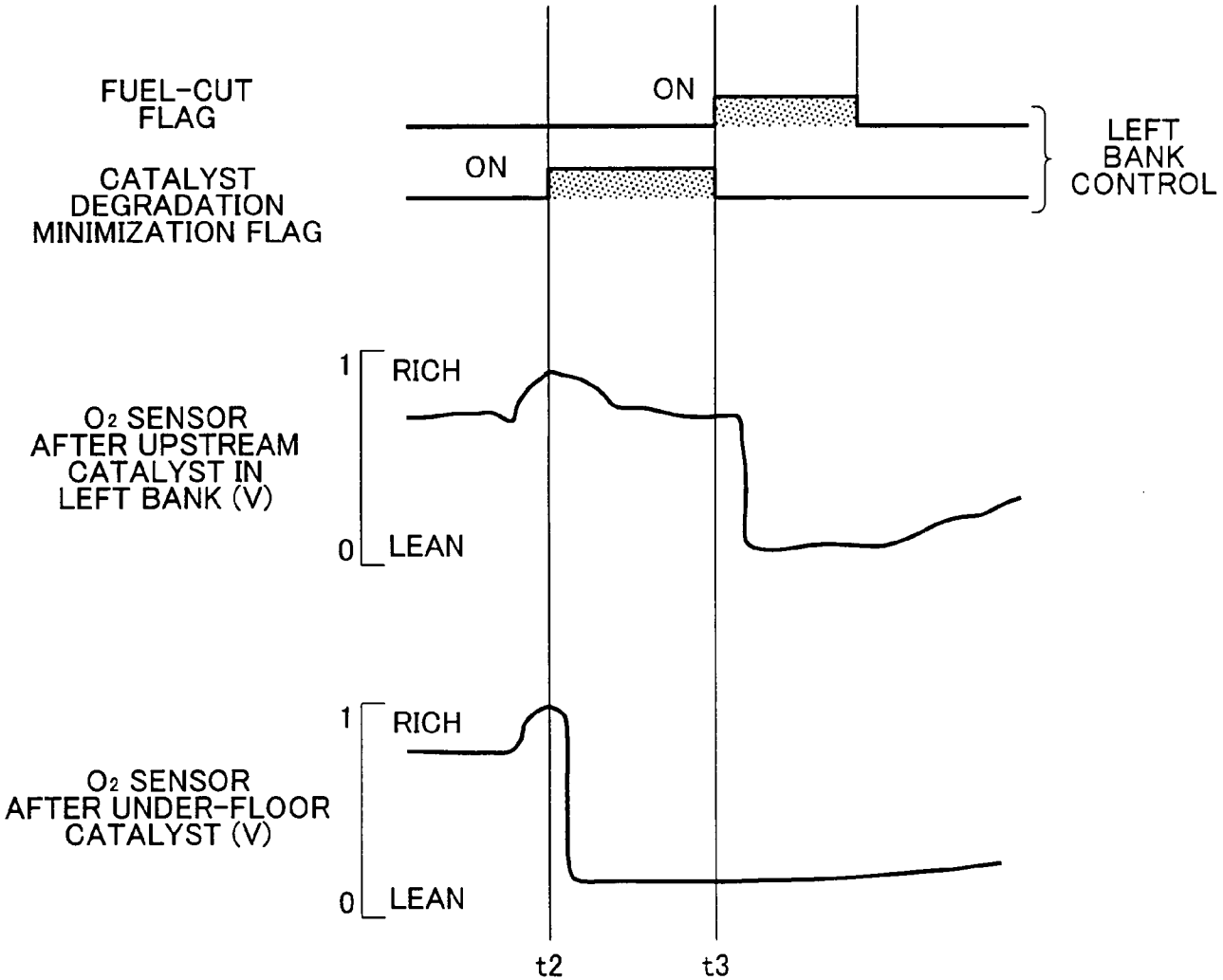

During such an operation state, the air-fuel ratio is rich and the intake air amount Ga is large, and therefore the temperature of the upstream catalyst 20 tends to be higher than the threshold used for the determination as to the condition for executing the catalyst degradation minimization control, as shown in FIG. 4C, and, as evident from FIGS. 4F, 4I, and 4J, the upstream catalyst 20, and the downstream catalyst 34 are exposed to a rich atmosphere. Assuming that the condition for executing fuel cut comes into effect in this state, if execution of fuel cut is prohibited and stoichiometric combustion is alternatively performed, the downstream catalyst 34 will be exposed to a still richer atmosphere, thus increasing the likelihood of exhaust odor.

To counter this, in the example shown in FIG. 4, fuel-cut is executed in the right bank 12 (FIGS. 4D and 4E) and the catalyst degradation minimization control is executed in the left bank 14 during the period from time t2 at which the fuel-cut execution condition comes into effect to time t3 at which the temperature of the catalyst becomes lower than a determination threshold, which is, in other words, the period over which the catalyst degradation minimization control should be performed for all the cylinders in normal states.

According to the control described above, since fuel-cut is performed in the right bank 12 while stoichiometric combustion is performed in the left bank 14, the air-fuel ratio of exhaust gas downstream of the downstream catalyst 34 become leans at substantially the same time as the air-fuel ratio of exhaust gas downstream of the upstream catalyst 20 in the right bank becomes lean. At this time, therefore, a sufficient amount of oxygen is supplied to the downstream catalyst 34. Thus, as known from the example shown in FIG. 4, it is possible to minimize catalyst exhaust odor due to sulfur poisoning of the downstream catalyst 34 by alternately executing the catalyst degradation minimization control and fuel cut between the right bank 12 and the left bank 14

As such, in the control routine shown in FIG. 2, when execution of the catalyst degradation minimization control is required, the bank in which the catalyst degradation minimization control is executed and the bank in which fuel cut is executed are alternately switched between the right bank 12 and the left bank 14 based on the result of comparison between the total fuel-cut time of each bank and the threshold $T_A$. In this way, it is possible to avoid the downstream catalyst 34 being exposed to a rich atmosphere and thus minimize exhaust odor from the downstream catalyst 34 by executing fuel cut in one of the right and left banks 12, 14 while performing the degradation minimization to the upstream catalyst 20 and the upstream catalyst 30 alternately as illustrated in FIG. 4. In addition, by switching the bank based on the total fuel-cut time as described above, it is possible to prevent one of the right and left banks 12, 14 from being exposed to a lean atmosphere for a much longer time than the other is, and therefore the unevenness of degradation between the upstream catalysts 20, 30 can be suppressed.

Note that, in the case that the catalyst degrades due to exposure to a high temperature lean atmosphere, the catalyst can be recovered by being exposed to a rich atmosphere shortly after the exposure to the lean atmosphere. Therefore, by alternately executing stoichiometric combustion (catalyst degradation minimization control) and fuel-cut prohibition (catalyst exhaust odor minimization control) between the right bank 12 and the left bank 14 as in the control routine shown in FIG. 2, it is possible to maintain the purification capacity of each upstream catalyst 20, 30 while minimizing exhaust odor from the downstream catalyst 34.

Accordingly, the system of this exemplary embodiment achieves a desired overall useful life of the catalysts (i.e., catalysts 20, 34) while minimizing catalyst exhaust odor. Note that, while combustion is performed at the stoichiometric air-fuel ratio during the catalyst degradation minimization control in the above exemplary embodiment, combustion, in view of recovering the catalyst, may be performed at an air-fuel ratio that is slightly richer than the stoichiometric air-fuel ratio during the catalyst degradation minimization control.

In the first exemplary embodiment described above, the ECU 40 realizes "fuel supply suspending means" by executing the process in step 112, "fuel supply suspension prohibiting means" by executing the processes in steps 100, 102, and 108, and "fuel supply suspension prohibition switching means" by executing the processes in step 104 to 112. Also, the ECU 40 realizes "air-fuel ratio controlling means" by executing the process in step 108.

Next, a second exemplary embodiment of the invention will be described with reference to FIG. 5 and FIG. 6. The system according to this exemplary embodiment is realized by the hardware configuration shown in FIG. 1 and the control routine shown in FIG. 5 that is executed by the ECU 40 instead of the control routine shown in FIG. 2.

In the first exemplary embodiment described above, execution of the catalyst degradation minimization control and execution of the fuel-cut are alternately switched between the two banks based on the total fuel-cut time of each bank. Meanwhile, the second exemplary embodiment is characterized in that the time at which the switching between the banks is performed is determined based on a catalyst stress that is a reference value reflecting the catalyst temperatures, the concentration of oxygen, and the running of the vehicle.

Figure 5:
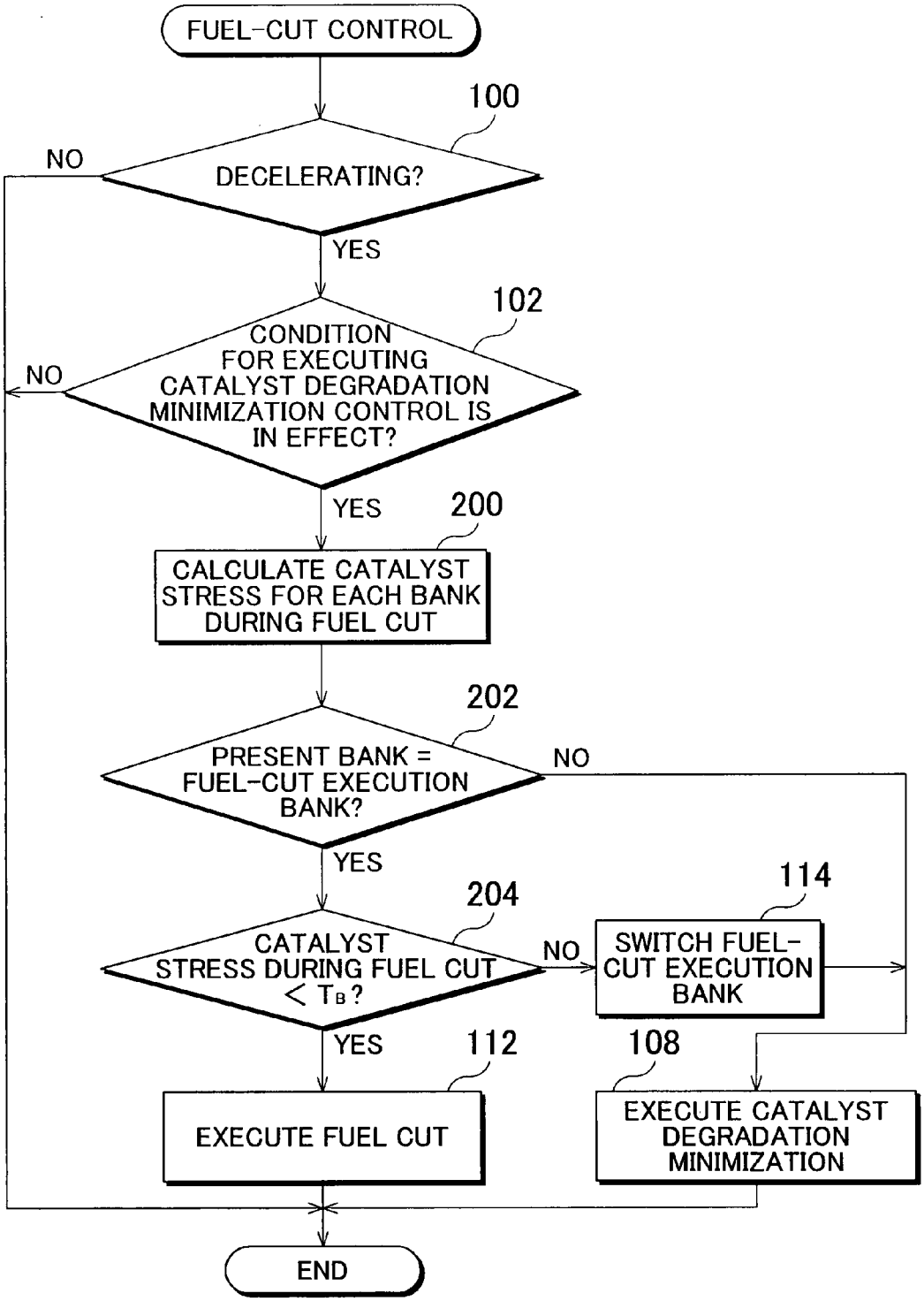
FIG. 5 is a flowchart showing a control routine executed in the second exemplary embodiment of the invention.

FIG. 5 is a flowchart showing a control routine executed by the ECU 40 to realize the above control in the second exemplary embodiment. This control routine is executed at a predetermined timing at which whether to perform fuel injection is determined for each cylinder in each cycle. Note that, in FIG. 5, the same steps as those in FIG. 2 are designated by the same numerals and their descriptions will be omitted or simplified.

In the control routine in FIG. 5, when the condition for executing the catalyst degradation minimization control is in effect (step 102), the catalyst stress to be produced during fuel cut is then calculated for each bank (step 200). FIG. 6 illustrates the concept of the catalyst stress calculated in step 200. As mentioned above, the catalyst stress is pre-stored in the ECU 40 as a reference value reflecting the catalyst temperature, the oxygen concentration, and the vehicle running time. For example, the catalyst stress can be calculated as the product of the coefficients of these three parameters using the following equation:

$$\text{catalyst stress} = \text{catalyst temperature coefficient} \times \text{oxygen concentration coefficient} \times \text{vehicle running time coefficient} \quad (1)$$

With regard to the above equation (1), the information regarding the catalyst temperature (catalyst temperature coefficient) can be obtained from the above-mentioned estimated temperature of each catalyst, the information regarding the oxygen concentration (oxygen concentration coefficient) can be obtained from the output of the air-fuel ratio sensor 22, and the vehicle running time (vehicle running time coefficient) can be determined using the timer function of the ECU 40.

Figure 6A:
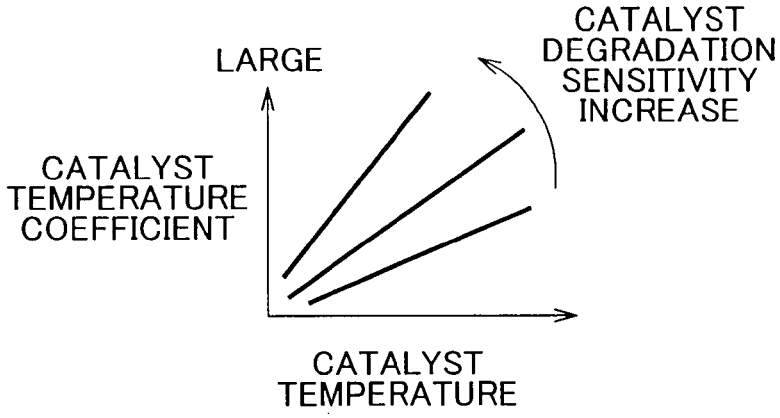
FIG. 6A to FIG. 6C are diagrams illustrating the concept of the catalyst stress calculated in step 200 in the control routine shown in FIG. 5.
Figure 6B:
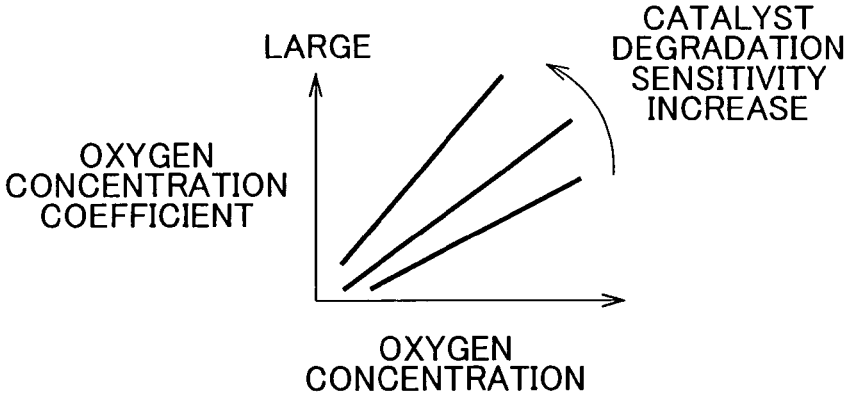
Figure 6C:
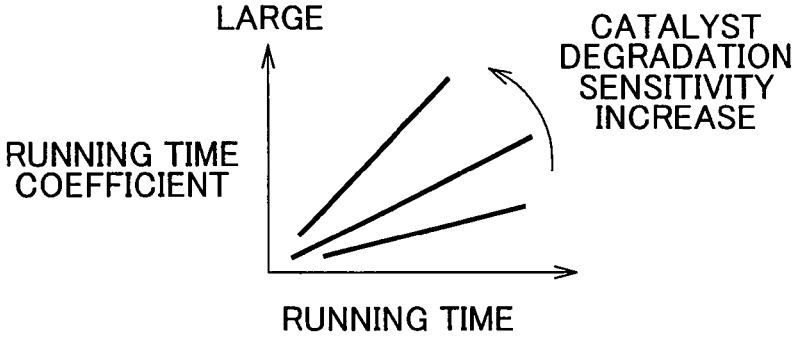

As conceptually illustrated in FIG. 6A, the catalyst stress tends to increase as the catalyst temperature increases. Also, as illustrated in FIG. 6B and FIG. 6C, the catalyst stress also tends to increases as the oxygen concentration increases and as the vehicle running time, which is in other words the time for which the catalyst has been exposed to exhaust gas, increases.

In the calculation of the catalyst stress in step 200, the catalyst degradation sensitivity is first calculated. The catalyst degradation sensitivity can be calculated by applying the catalyst temperature, the capacity of the catalyst, the amount of precious metal carried on the catalyst, and the oxygen concentration to the following equitation;

$$\text{catalyst degradation sensitivity} = \alpha \times \text{catalyst temperature} + \beta \times \text{catalyst capacity} + \gamma \times \text{carried precious metal amount} + \delta \times \text{oxygen concentration} - \epsilon \quad (2)$$

Note that $\alpha$, $\beta$, $\gamma$, $\delta$, and $\epsilon$ in the above equitation (2) are experimental values. Also, the above-described estimated catalyst temperature can be used as "catalyst temperature", and "catalyst capacity" and "carried precious metal amount" are values defined in the specifications of the upstream catalysts 20, 30 and the downstream catalyst 34. The value of "oxygen concentration" is set to, for example, 0.001 (0.1%) during feedback control of air-fuel ratio, and to 0.21 (21%) during fuel cut.

Thus, using the catalyst degradation sensitivity calculated by the equitation (2) described above, it is possible to estimate the present state of each catalyst in accordance with the specification of each catalyst 20, 30, 34 provided in the internal combustion engine 10. Then, the catalyst stress is calculated as the product of the respective coefficients in the equitation 1, which are calculated based on the relations with the foregoing catalyst degradation sensitivity. More specifically, for example, assuming that the temperature of the catalyst is at a certain level, when the estimated catalyst degradation sensitivity is relatively high, the catalyst temperature coefficient is made larger than it is when the estimated catalyst degradation sensitivity is relatively low.

Next, in the control routine in FIG. 5, it is determined whether the cylinder corresponding to the present cycle of the control routine belongs to the bank that is presently defined as the fuel-cut execution bank (step 202). If it is determined in this step that the cylinder corresponding to the present cycle of the control routine does not belong to the fuel-cut execution bank, the catalyst degradation minimization control is then performed for this cylinder (step 108).

On the other hand, if it is determined in step 202 that the cylinder corresponding to the present cycle of the control routine belongs to the fuel-cut execution bank, it is then determined whether the catalyst stress of the upstream catalyst 20, 30 in the present fuel-cut execution bank is less than the threshold $T_B$ (step 204).

If it is determined in step 204 that the catalyst stress has not yet reached the threshold $T_B$, fuel cut is then executed in this cylinder to avoid the downstream catalyst 34 being exposed to a rich atmosphere (step 112). On the other hand, if it is determined in step 204 that the catalyst stress has reached the threshold $T_B$, the fuel-cut execution bank is switched to other bank (step 114), and the catalyst degradation minimization control is performed (step 108).

According to the control routine shown in FIG. 5, when execution of the catalyst degradation minimization control is required, the bank in which the catalyst degradation minimization control is executed and the bank in which fuel cut is executed are alternately switched between the right bank 12 and the left bank 14 based on the catalyst stress described above. In this manner, the degree of degradation of each catalyst can be more accurately estimated than it is in the first exemplary embodiment, and therefore, the catalyst degradation minimization can be more reliably performed with the catalysts 20, 30. during the foregoing bank switching control.

In the second exemplary embodiment described above, the ECU 40 realizes "first oxygen concentration obtaining means" by obtaining the oxygen concentration in the upstream catalyst 20 based on the outputs from the air-fuel ratio sensor 22 or "second oxygen concentration obtaining means" by obtaining the oxygen concentration in the upstream catalyst 30 based on the outputs from the air-fuel ratio sensor 22. The ECU 40 also realizes "running time obtaining means" by obtaining the running time using the timer function of the ECU 40. The catalyst stress corresponds to "reference value".

Hereinafter, a third exemplary embodiment of the invention will be described with reference to FIG. 7 to FIG. 9. The system according to this exemplary embodiment is realized by the hardware configuration shown in FIG. 1 and the control routine shown in FIG. 7 that is executed by the ECU 40 instead of the control routine shown in FIG. 2.

In the first exemplary embodiment described above, execution of the catalyst degradation minimization control and execution of fuel-cut are alternately switched between the two different banks based on the total fuel-cut time of each bank. Meanwhile, the third exemplary embodiment is characterized in that execution of the catalyst degradation minimization control and execution of the fuel-cut are alternately switched between the two different banks based on the degree of degradation of the catalysts 20, 30. that is determined from the maximum adsorbed oxygen amount Cmax of each of the upstream catalysts 20, 30.

Figure 7:
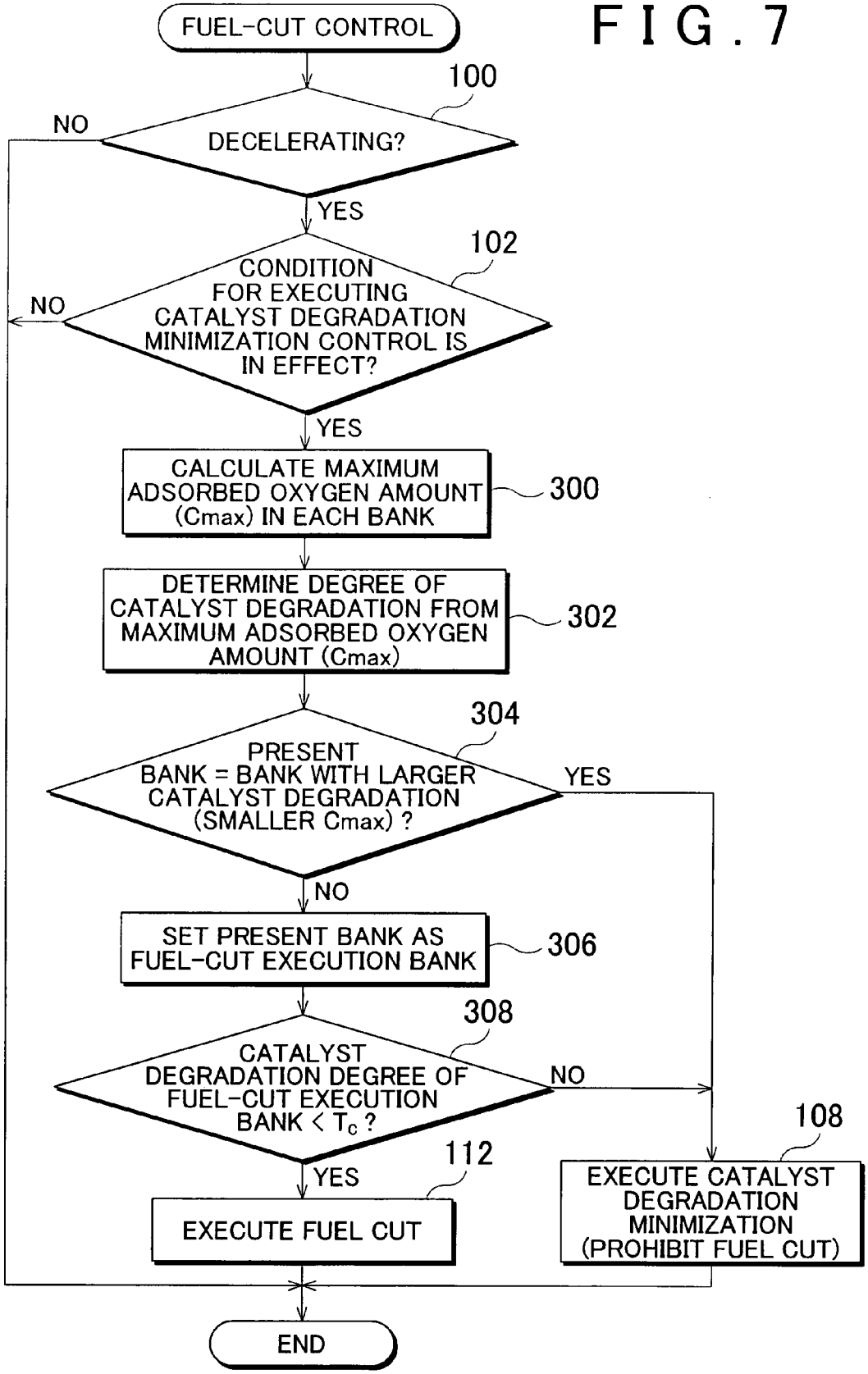
FIG. 7 is a flowchart showing a control routine executed in the third exemplary embodiment of the invention.

FIG. 7 is a flowchart showing a control routine executed by the ECU 40 to realize the above control in the third exemplary embodiment. This control routine is executed at a predetermined timing at which whether to perform fuel injection is determined for each cylinder in each cycle. Note that, in FIG. 7, the same steps as those in FIG. 2 are designated by the same numerals and their descriptions will be omitted or simplified.

In the control routine in FIG. 7, when the condition for executing the catalyst degradation minimization control is in effect (step 102), the present maximum adsorbed oxygen amount Cmax in each bank 12, 14, that is, in each upstream catalyst 20, 30 is obtained (step 300). The ECU 40 repeatedly calculates the maximum adsorbed oxygen amount of each upstream catalyst 20, 30. based on a target air-fuel ratio and the outputs from the sub-$O_2$ sensor 24 at intervals of predetermined travel distances of the vehicle. Because a known method can be used to calculate the maximum adsorbed oxygen amount Cmax, its description will be omitted.

Figure 8:
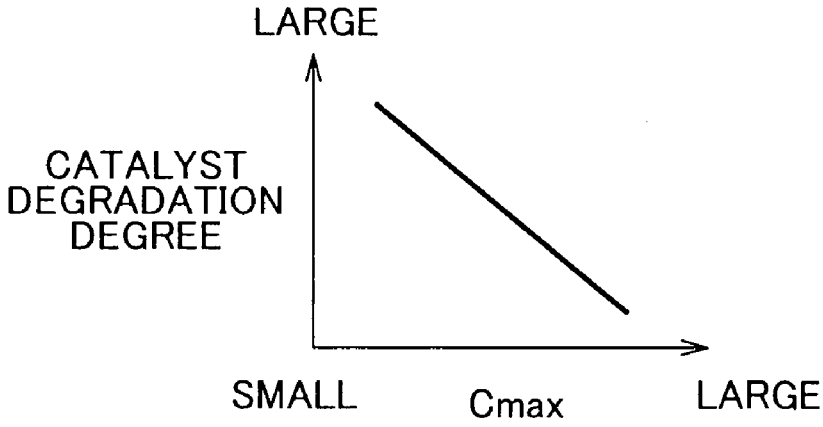
FIG. 8 is a diagram illustrating the relation between the degree of catalyst degradation and the maximum adsorbed oxygen amount Cmax.

Next, the degree of degradation of each catalyst 20, 30 is determined based on the maximum adsorbed oxygen amount Cmax obtained in step 300 with reference to the relation illustrated in FIG. 8 (step 302). FIG. 8 illustrates the relation between the degree of catalyst degradation and the maximum adsorbed oxygen amount Cmax. As mentioned above, degradation of each catalyst progresses, for example, under a high-temperature lean atmosphere, and as a result, the maximum adsorbed oxygen amount decreases. Therefore, the relation illustrated in FIG. 8 is defined such that the degree of catalyst degradation is determined to be higher as the maximum adsorbed oxygen amount is larger.

Next, it is determined whether the cylinder corresponding to the present cycle of the control routine belongs to the bank, the catalyst degradation degree of which is presently larger than that of the other bank (step 304). If it is determined in this step that the cylinder corresponding to the present cycle of the control routine belongs to the bank with the larger catalyst degradation degree, the catalyst degradation minimization control is then performed to this cylinder to minimize the degradation of the upstream catalyst in this bank (step 108).

On the other hand, if it is determined in step 304 that the cylinder corresponding to the present cycle of the control routine does not belong to the bank with the larger catalyst degradation degree, the bank to which the present cylinder belong is then defined as the fuel-cut execution bank (step 306).

Then, it is determined whether the degree of catalyst degradation of the present fuel-cut execution bank is smaller than a threshold $T_C$ (step 308). The threshold $T_C$ is a value used to determine, when it is determined that the cylinder belongs to the bank with the smaller degree of catalyst degradation, whether to execute fuel cut in the cylinder.

If it is determined in step 308 that the catalyst degradation degree has not yet reached the threshold $T_C$, fuel cut control is then executed to this cylinder in order to avoid the downstream catalyst 34 being exposed to a rich atmosphere (step 112).

On the other hand, if it is determined in step 308 that the catalyst degradation degree has reached the threshold $T_C$, the catalyst degradation minimization control is executed also to the cylinder corresponding to the present cycle of the control routine (step 108). That is, the catalyst capacity for storing sulfur oxides decreases as the degradation of the catalyst progresses, and as the upstream catalysts degrade, the downstream catalyst degrades accordingly. Therefore, when the degree of degradation of each upstream catalyst 20, 30 is equal to or larger than the threshold $T_C$, the likelihood of exhaust odor from the downstream catalyst 34 is considered to be low. Accordingly, when the catalyst degradation degree has reached the threshold $T_C$, it is judged that there is no need to execute fuel cut in the present bank, that is, the bank with the smaller catalyst degradation degree, and the catalyst degradation minimization control is executed instead of fuel cut.

According to the control routine shown in FIG. 7, in the case that execution of the catalyst degradation minimization control is required, higher priority is given to executing the catalyst degradation minimization control to the upstream catalyst that has degraded more than the other.

Figure 9:
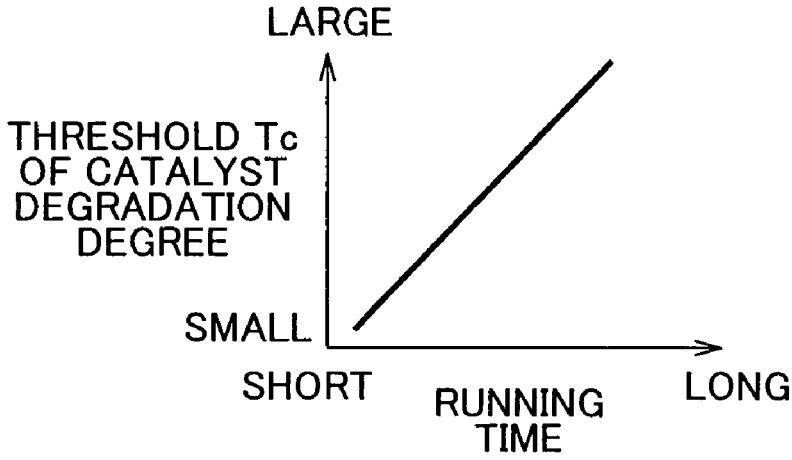
FIG. 9 is a diagram illustrating the relation between the value of the threshold $T_C$ and the vehicle running time.

While the threshold $T_C$ has been explained as a fixed value in the above description regarding the third exemplary embodiment, the threshold $T_C$ may vary as illustrated in FIG. 9. FIG. 9 illustrates the relation between the value of the threshold $T_C$ and the vehicle running time. In general, as the vehicle running time increases, the degradation of a catalyst progresses and the maximum adsorbed oxygen amount of the catalyst decreases. Therefore, the relation shown in FIG. 9 is defined such that the threshold $T_C$ decreases as the vehicle running time increases. Accordingly, using the relation shown in FIG. 9, it is possible to obtain the value of the threshold $T_C$ that reflects changes in the property of the catalyst due to aging. Note that, for example, the catalyst stress described in the second exemplary embodiment may be used instead of the vehicle running time in this control. In this case, the threshold $T_C$ is reduced as the catalyst stress increases.

In the third exemplary embodiment described above, the ECU 40 realizes "second catalyst degradation degree estimating means" by executing the process in step 300, and "degradation degree comparing means" by executing the process in step 302.

Hereinafter, a forth exemplary embodiment of the invention will be described with reference to FIG. 10. The system according to this exemplary embodiment is realized by the hardware configuration shown in FIG. 1 and the control routine shown in FIG. 10 that is executed by the ECU 40 instead of the control routine shown in FIG. 2.

In the first to third exemplary embodiments described above, when execution of the catalyst degradation minimization control is required, the bank in which the catalyst degradation minimization control is executed and the bank in which fuel cut is executed are alternately switched. In this case, however, there arises a difference between the torque output from the bank in which fuel cut is executed, that is, no combustion is performed, and the torque output from the bank in which the catalyst degradation minimization control is executed, that is, stoichiometric combustion is performed. In the forth exemplary embodiment, therefore, the ECU 40 executes the control routine shown in FIG. 10 to suppress such a torque difference between the right bank 12 and the left bank 14.

Figure 10:
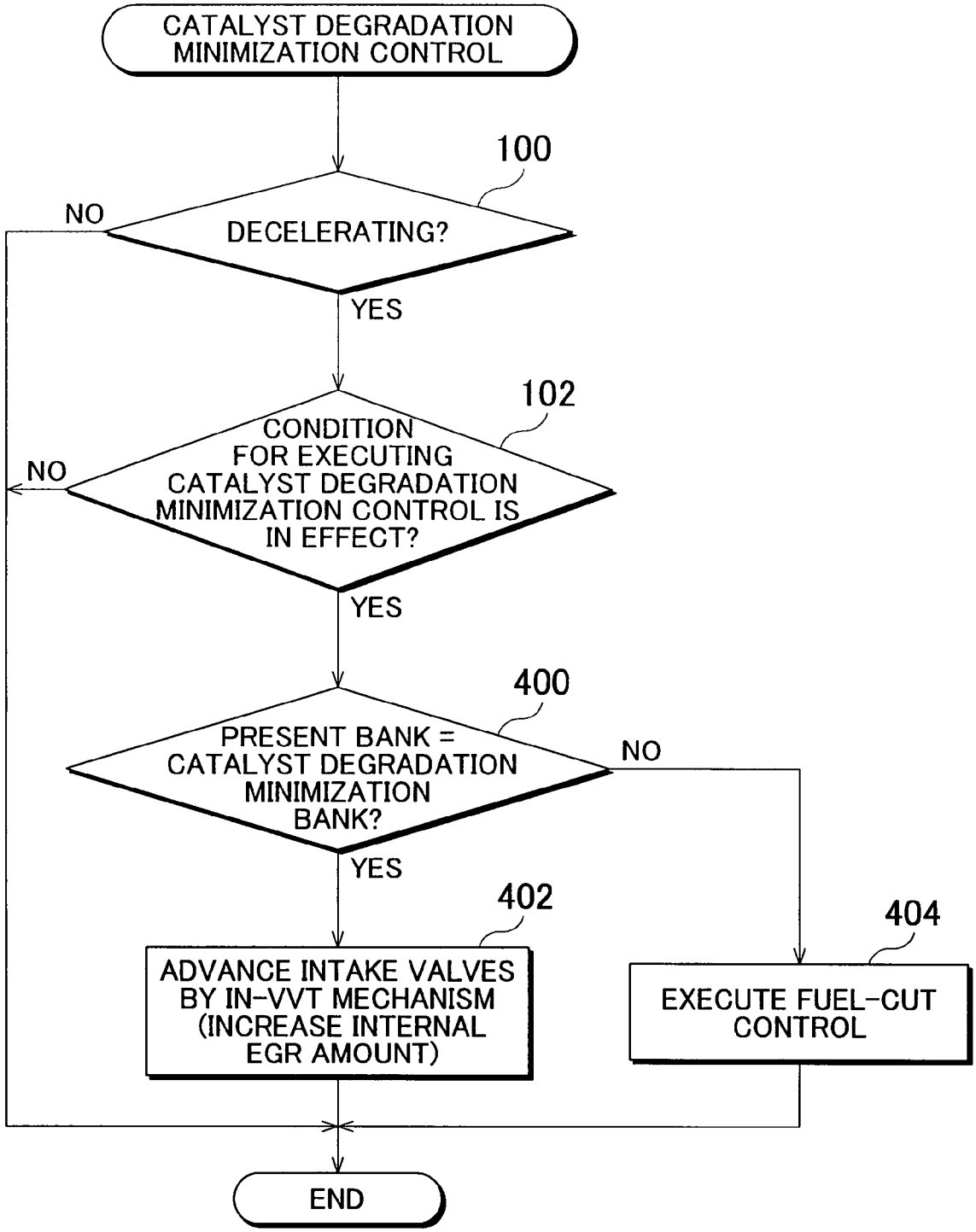
FIG. 10 is a flowchart showing a control routine executed in the fourth exemplary embodiment of the invention.

FIG. 10 is a flowchart showing a control routine executed by the ECU 40 to realize the above control in the forth exemplary embodiment. This control routine is executed in parallel with the control routine shown in FIG. 2, 5, or 7. Note that, in FIG. 10, the same steps as those in FIG. 2 are designated by the same numerals and their descriptions will be omitted or simplified.

In the control routine in FIG. 10, when the condition for executing the catalyst degradation minimization control is in effect (step 102), it is then determined whether the catalyst degradation minimization control is to be executed in the bank to which the cylinder corresponding to the present cycle of the control routine belongs (step 400).

If it is determined in step 400 that the catalyst degradation minimization control is to be executed in the bank to which the cylinder corresponding to the present cycle of the control routine belongs, a command is given to the intake VVT mechanism 52 such that the intake valves in the catalyst degradation minimization control bank will open earlier than the intake valves in the fuel cut bank do (step 402). On the other hand, if it is determined in step 400 that the catalyst degradation minimization control is not to be executed in the bank to which the cylinder corresponding to the present cycle of the routine belongs, fuel cut is then performed (step 404).

According to the control routine illustrated in FIG. 10, when execution of the catalyst degradation minimization control is required during deceleration of the internal combustion engine 10, the opening timing of the intake valves of the cylinder in the bank in which the catalyst degradation minimization control is to be executed is advanced and thus the valve overlap period increases. As the valve overlap period increases, the amount of internal EGR gas (remaining gas) increases. As a result, the torque output from this cylinder decreases. In this way, it is possible to suppress a torque difference between the right bank 12 and the left bank 14, which may occur when execution of fuel cut and execution of the catalyst degradation minimization control are being alternately switched between the right bank 12 and the left bank 14, and thus to minimize deterioration of the driveability of the vehicle.

When suppressing the torque difference between the banks 12, 14, the internal EGR gas may be increased by increasing the valve overlap period by retarding the operation timing of the exhaust valves using the exhaust VVT mechanism 54, instead of advancing the operation timing of the intake valves. Further, in the case of an internal combustion engine in which each of the right and left banks has an independent EGR passage connecting the exhaust passage and the intake passage, the internal EGR gas may be increased by performing external EGR controls using an EGR valve.

Among these options for increasing the internal EGR gas, however, increasing the internal EGR gas by advancing the opening timing of the intake valves as in the forth exemplary embodiment provides the following advantage. That is, when the opening timing of the intake valves is advanced, the high temperature gas produced by combustion in each cylinder is pushed back into the intake port during the valve overlap period. This high temperature combusted gas then atomizes the fuel remaining on the intake valves and the internal walls of the intake port, and this stabilizes the fuel economy regardless of the increase of the internal EGR gas.

Note that, in the forth exemplary embodiment described above, the intake VVT mechanism 52 corresponds to "EGR controlling means".

In the first to forth exemplary embodiments described above, the internal combustion engine 10, which is a V type engine, has been used as one example of an engine having a configuration of exhaust components, which is suitable for the invention. However, it is to be noted that any internal combustion engine, such as an in-line engine and a boxer engine, may be used as long as it includes two cylinder groups, upstream catalysts separately provided for the respective cylinder groups, and a downstream catalyst provided in an exhaust passage downstream of the confluence of the exhaust passages in which the upstream catalysts are provided, respectively.

What is claimed is:

1. A control apparatus for an internal combustion engine, including:

a first cylinder group;

a second cylinder group;

a first upstream catalyst provided in an exhaust passage extended from the first cylinder group;

a second upstream catalyst provided in an exhaust passage extended from the second cylinder group;

a downstream catalyst provided in a portion downstream of a confluence of the first exhaust passage and the second exhaust passage, the confluence being located downstream of the first upstream catalyst and the second upstream catalyst; and a fuel supply suspending portion that suspends supply of fuel during deceleration, the control apparatus comprising a stoichiometric performing portion that performs stoichiometric combustion by controlling an air-fuel ratio to a stoichiometric air-fuel ratio in one of the first cylinder group and the second cylinder group when one of a temperature of the first upstream catalyst and a temperature of the second upstream catalyst is higher than a predetermined value during deceleration, wherein:

the fuel supply suspending portion performs fuel supply suspending control in the other of the first cylinder group and the second cylinder group when one of the temperature of the first upstream catalyst and the temperature of the second upstream catalyst is higher than the predetermined value; and the control apparatus further comprises a fuel supply suspension switching portion that alternately switches the cylinder group in which the stoichiometric combustion is performed and the cylinder group in which the fuel supply suspending control is executed between the first cylinder group and the second cylinder group;

the control apparatus further comprising:

a first catalyst degradation degree estimating portion that estimates the degree of degradation of the first upstream catalyst;

a second catalyst degradation degree estimating portion that estimates the degree of degradation of the second upstream catalyst; and a degradation degree comparing portion that compares the degree of degradation of the first upstream catalyst and the degree of degradation of the second upstream catalyst, wherein the stoichiometric combustion is performed in the cylinder group with the catalyst that the degradation degree comparing portion determines to have degraded to a higher degree.

2. A control apparatus for an internal combustion engine, including:

a first bank including a first cylinder group;

a second bank including a second cylinder group;

a first upstream catalyst provided in an exhaust passage extended from the first cylinder group;

a second upstream catalyst provided in an exhaust passage extended from the second cylinder group;

a downstream catalyst provided in a portion downstream of a confluence of the first exhaust passage and the second exhaust passage, the confluence being located downstream of the first upstream catalyst and the second upstream catalyst; and a fuel suspending portion that suspends supply of fuel during deceleration, the control apparatus comprising a stoichiometric combustion performing portion that performs stoichiometric combustion by controlling an air-fuel ratio to a stoichiometric air-fuel ratio in one of the first cylinder group and the second cylinder group when one of a temperature of the first upstream catalyst and a temperature of the second upstream catalyst is higher than a predetermined value during deceleration, wherein:

the fuel supply suspending portion performs fuel supply suspending control in the other of the first cylinder group and the second cylinder group when one of the temperature of the first upstream catalyst and the temperature of the second upstream catalyst is higher than the predetermined value; and the controller further comprises a fuel supply suspension switching portion that alternately switches the cylinder group in which the stoichiometric combustion is performed and the cylinder group in which the fuel supply suspending control is executed between the first cylinder group and the second cylinder group;

the control apparatus further comprising:

a first catalyst degradation degree estimating portion that estimates the degree of degradation of the first upstream catalyst;

a second catalyst degradation degree estimating portion that estimates the degree of degradation of the second upstream catalyst; and a degradation degree comparing portion that compares the degree of degradation of the first upstream catalyst and the degree of degradation of the second upstream catalyst, wherein the stoichiometric combustion is performed in the cylinder group with the catalyst that the degradation degree comparing portion determines to have degraded to a higher degree.

3. The control apparatus according to claim 1, further comprising:

a fuel supply suspension time calculating portion that calculates a total time of the fuel supply suspending control by the fuel supply suspending portion, wherein the fuel supply suspension switching portion switches the cylinder group in which the stoichiometric combustion is performed and the cylinder group in which the fuel supply suspending control is executed from one of the first cylinder group and the second cylinder group to the other if the total time of the fuel supply suspending control calculated by the fuel supply suspension time calculating portion is longer than a predetermined value.

4. The control apparatus according to claim 2, further comprising:

a fuel supply suspension time calculating portion that calculates a total time of the fuel supply suspending control by the fuel supply suspending portion, wherein the fuel supply suspension switching portion switches the cylinder group in which the stoichiometric combustion is performed and the cylinder group in which the fuel supply suspending control is executed from one of the first cylinder group and the second cylinder group to the other if the total time of the fuel supply suspending control calculated by the fuel supply suspension time calculating portion is longer than a predetermined value.

5. The control apparatus according to claim 1, further comprising:

a first oxygen concentration obtaining portion that obtains oxygen concentration in the first upstream catalyst;

a second oxygen concentration obtaining portion that obtains an oxygen concentration in the second upstream catalyst; and a running time obtaining portion that obtains a running time, wherein the fuel supply suspension switching portion switches the cylinder group in which the stoichiometric combustion is performed and the cylinder group in which the fuel supply suspending control is executed, based on a reference value reflecting at least one of a catalyst temperature in the cylinder group in which the fuel supply suspending control is being executed by the fuel supply suspending portion, an oxygen concentration in the same cylinder group, and a running time.

6. The control apparatus according to claim 2, further comprising:

a first oxygen concentration obtaining portion that obtains oxygen concentration in the first upstream catalyst;

a second oxygen concentration obtaining portion that obtains an oxygen concentration in the second upstream catalyst; and a running time obtaining portion that obtains a running time, wherein the fuel supply suspension switching portion switches the cylinder group in which the stoichiometric combustion is performed and the cylinder group in which the fuel supply suspending control is executed, based on a reference value reflecting at least one of a catalyst temperature in the cylinder group in which the fuel supply suspending control is being executed by the fuel supply suspending portion, an oxygen concentration in the same cylinder group, and a running time.

7. The control apparatus according to claim 3, further comprising:

an EGR control portion that controls the amount of re-circulated exhaust gas, wherein the EGR control portion makes the amount of re-circulated exhaust gas for the cylinder group, in which the stoichiometric combustion is performed by the stoichiometric combustion performing portion, larger than the amount of re-circulated exhaust gas for the other cylinder group.

8. The control apparatus according to claim 4, further comprising:

an EGR control portion that controls the amount of re-circulated exhaust gas, wherein the EGR control portion makes the amount of re-circulated exhaust gas for the cylinder group, in which the stoichiometric combustion is performed by the stoichiometric combustion performing portion, larger than the amount of re-circulated exhaust gas for the other cylinder group.

9. The control apparatus according to claim 5, further comprising:

an EGR control portion that controls the amount of re-circulated exhaust gas, wherein the EGR control portion makes the amount of re-circulated exhaust gas for the cylinder group, in which the stoichiometric combustion is performed by the stoichiometric combustion performing portion, larger than the amount of re-circulated exhaust gas for the other cylinder group.

10. The control apparatus according to claim 6, further comprising:

an EGR control portion that controls the amount of re-circulated exhaust gas, wherein the EGR control portion makes the amount of re-circulated exhaust gas for the cylinder group, in which the stoichiometric combustion is performed by the stoichiometric combustion performing portion, larger than the amount of re-circulated exhaust gas for the other cylinder group.

11. The control apparatus according to claim 1, further comprising:

an EGR control portion that controls the amount of re-circulated exhaust gas, wherein the EGR control portion makes the amount of re-circulated exhaust gas for the cylinder group, in which the stoichiometric combustion is performed by the stoichiometric combustion performing portion, larger than the amount of re-circulated exhaust gas for the other cylinder group.

12. The control apparatus according to claim 2, further comprising:

an EGR control portion that controls the amount of re-circulated exhaust gas, wherein the EGR control portion makes the amount of re-circulated exhaust gas for the cylinder group, in which the stoichiometric combustion is performed by the stoichiometric combustion performing portion, larger than the amount of re-circulated exhaust gas for the other cylinder group.

* * * * *